United States Patent [19]

Harms

[11] Patent Number: 5,067,265

[45] Date of Patent: Nov. 26, 1991

[54] BADGE AND MOUNTING ASSEMBLY

[75] Inventor: Jeffrey W. Harms, Olathe, Kans.

[73] Assignee: Gill Studios, Inc., Shawnee Mission, Kans.

[21] Appl. No.: 528,035

[22] Filed: May 23, 1990

[51] Int. Cl.[5] ..... A44C 3/00

[52] U.S. Cl. ..... 40/1.5; 24/703.1

[58] Field of Search ..... 40/1.5, 591; 24/703.1, 24/94, 96

[56] References Cited

U.S. PATENT DOCUMENTS

| | | | |
|---|---|---|---|
| 621,541 | 3/1899 | Richardson | 24/94 |
| 1,178,738 | 3/1916 | Lichter | 24/94 |
| 1,873,880 | 4/1932 | Hall et al. | 24/703.1 |
| 2,153,157 | 4/1939 | Priesmeyer | 40/1.5 |
| 2,208,283 | 7/1940 | Stader | 24/103 |
| 2,373,499 | 4/1945 | Passanante | 40/1.5 |
| 2,867,815 | 1/1959 | Wittenberg | 40/1.5 |
| 3,083,484 | 4/1963 | Schoenfein | 40/1.5 |
| 3,139,690 | 7/1964 | Hait | 40/1.5 |
| 3,257,747 | 6/1966 | Schimmel | 40/1.5 |
| 3,357,547 | 12/1967 | Jensen | 24/94 |
| 3,439,439 | 4/1969 | Stimson | 40/1.5 |
| 3,810,321 | 5/1974 | Kiba | 40/1.5 |
| 4,155,183 | 5/1979 | Abrahams | 40/1.5 |
| 4,261,121 | 4/1981 | Coon | 40/666 |
| 4,604,819 | 8/1986 | Grey | 40/1.5 |
| 4,691,457 | 9/1987 | Peroni | 40/158.1 |
| 4,698,927 | 10/1987 | Yoshiro | 40/1.6 |

*Primary Examiner*—Kenneth J. Dorner
*Assistant Examiner*—Cassandra L. Hope
*Attorney, Agent, or Firm*—Litman, McMahon & Brown

[57] ABSTRACT

A badge having an attachment assembly for securing to wearing apparel, paramagnetic surfaces or the like includes a pin, clip or magnetic mounting assembly secured to the badge. The attachment assembly is mounted on a central post to facilitate automated placement of the mounting assembly on the post. A latching pin mechanism for use as the attachment assembly includes a loop for mounting on the central post and spring biased pin offset from the loop to allow the badge to hang appropriately even though supported by the central post. Alternative embodiments utilize a magnet, slide-on clip or biased jaw alligator clip as the attachment assembly.

7 Claims, 3 Drawing Sheets

BADGE AND MOUNTING ASSEMBLY

BACKGROUND OF THE INVENTION

The present invention relates to badge type devices which are secured to clothing or other objects by a mounting mechanism and are for the purpose of displaying a message, a name or the like.

As many badges are intended for relatively short or medium term applications, it is essential that manufacturing costs be maintained at a minimum while retaining reliable usage of such badges.

Most existing badges employ designs whereby the face has a fixed orientation relative to the mounting mechanism. As a result, several limiting considerations are introduced. First, the orientation of the mounting mechanism must be taken into consideration when applying the message to be displayed by the badge.

Secondly, mounting structure for securing an attachment mechanism to the rear of the badge is generally non-symmetrically situated in order to ensure that the badge hangs properly during use. Therefore, complex and expensive equipment must be developed to identify, mechanically "feel" or otherwise locate the mounting structure and then mechanically and physically orient the badge for the securement of the said attachment mechanism thereto. The additional cost for the complex equipment required to maneuver the badge during the manufacturing process contributes to defeating the purpose of mass producing low-cost badges.

Thirdly, the orientation of the message on the face of the badge must be taken into consideration when attaching the badge to clothing or other materials or surfaces for its final intended purpose. Because of the fixed orientation of the message relative to the attachment mechanism of conventional badges, little flexibility remains to adapt attachment of the badge under varying circumstances, such as physically aligning the attachment mechanism horizontally for one application, and vertically for another. Further, it is desirable to have the center of the badge offset from the point of attachment to clothing or the like, so the badge will hang properly.

A centrally located post and the rotatable mounting mechanisms that provide an offset attachment to clothing in accordance with the present invention, eliminate the foregoing limitations.

SUMMARY OF THE INVENTION

A badge and mounting assembly which is the subject matter of the present invention discloses a badge body, which can be constructed of plastic at low cost and is mass producible with automated equipment, having a centrally located post. Because the post is centrally located, an attachment mechanism can be subsequently rotatably, coaxially and pivotally secured to the central post by mean of automated machinery without requiring that the badge body first be aligned in a particular manner before the attachment mechanism is mounted. That is, since the post is in the center of the body, the central post is very easy to positively locate by mechanized equipment and the attachment mechanism can then be easily placed over the post. This central post allows the use of much simpler automated machinery as compared to the prior art that required preliminary rotation of the badge body to a preset angular position so that an attachment mechanism would align with the proper connection thereof to the body.

In one embodiment of the present invention, an offset pin mounting mechanism permits attachment of the badge to clothing or the like at a position offset from the center so that the badge will hang properly while also allowing re-orientation of the badge after attachment to clothing.

In another embodiment of the present invention, a resilient, slide-on clip mounting mechanism is provided which clasps against clothing or the like so as to frictionally secure the badge in place.

In another embodiment of the present invention, an "alligator" or "bulldog" type clip having a biased jaw is utilized as the mounting mechanism to hold clothing or the like between opposed jaws that are biased together.

In another embodiment of the present invention, a magnetic mounting mechanism is utilized to magnetically secure the badge to a paramagnetic material.

OBJECTS OF THE INVENTION

Therefore, the objects of the present invention are: to provide a badge and a mounting assembly whereby the badge body can be manufactured without concern for the orientation of the mounting assembly; to provide a badge and a mounting assembly whereby the mounting assembly can be attached to the badge without concern for the orientation of the information printed on or affixed to the badge; to provide a badge which is readily adaptable to a pin mounting mechanism for attachment to relatively thin penetrable material to both slide-on and biased jaw clip mounting mechanisms for frictional attachment to relatively thin material, and to a magnetic mounting mechanism for attachment to paramagnetic materials; to provide a badge with a centrally located post on the rear side thereof to rotatably, coaxially and pivotally secure said mounting mechanisms; to provide such a pin mounting mechanism that includes a mounting pin located in spaced relationship to a rotatable mounting ring for the pin mounting mechanism so as to allow the badge to hang properly; and to provide such a badge which is relatively easy to manufacture, inexpensive to produce and particularly well adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
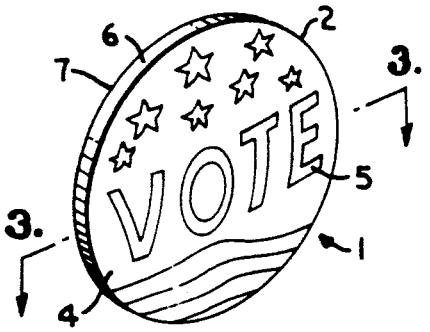
FIG. 1 is a front perspective view of a badge body in accordance with the present invention having a main body and a pin connecting assembly.
Figure 2:
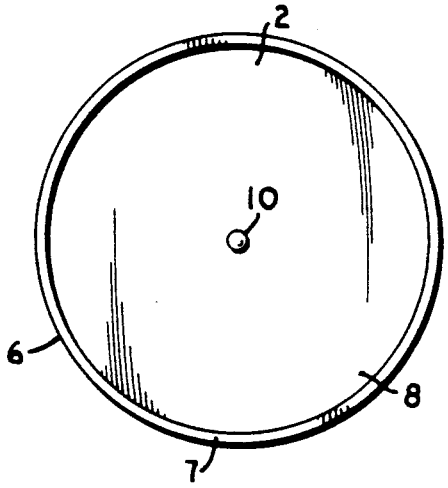
FIG. 2 is an enlarged rear elevational view of the badge showing the body prior to attachment of the connecting assembly.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Illustrated in FIGS. 1 through 6 is a first embodiment of a badge assembly according to the present invention and generally designated by the reference numeral 1.

The badge assembly 1 includes a badge body 2, preferably constructed of a readily moldable plastic or other deformable material. The badge body 2 has a front face 4 with indicia 5 thereon such as names, slogans, product information or the like. The indicia 5 may be applied in any conventional manner to the badge 4, such as being printed, etched or otherwise directly attached or on a decal glued or otherwise affixed thereto. Preferably, the front face 4 has a circular shaped configuration.

Figure 3:
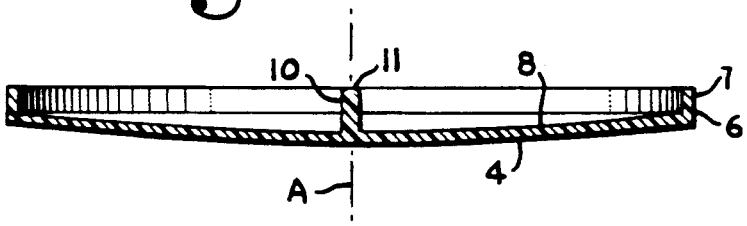
FIG. 3 is an enlarged cross-sectional view of the badge body, taken along line 3—3 of FIG. 1.
Figure 4:
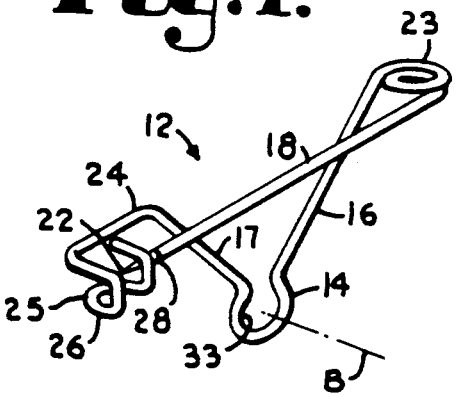
FIG. 4 is an enlarged perspective view of the connecting assembly of the badge.

The badge body 2 has a circular circumferential edge 6 extending rearwardly to form an outer rearward extending flange or rim 7, as shown in FIG. 3. Although the illustrated rim 7 is continuous, it is foreseen that the rim 7 may be non-continuous or intermittent also. The badge body 2 includes a rear face 8 with an integral, generally cylindrically-shaped post 10 extending perpendicularly rearward or transversely outward therefrom and being centrally located thereon. For ease of assembly, a distal end 11 of post 10 will preferably be rounded and of a size and shape to snugly receive a pin mounting device 12 as generally shown in FIG. 4. The post 10 has a central axis generally designated by the reference letter A.

The pin mounting device 12 has a base portion 14, a pair of arm or shank portions 16 and 17 and a pin portion 18 formed of an elongate continuous resilient wire or the like. The base portion 14 allows the pin mounting device 12 to be rotatably, pivotally, and coaxially secured to the post 10. While it is preferred that pin mounting device 12 be formed of an integral length of springy material, such as wire, it is foreseen that the base portion 14 may alternatively be constructed of individual components. Preferably, the base portion 14 is a circular segment, greater in arc than a semi-circle, with a diameter which can be slidably pressed onto post 10, so as to sufficiently encircle the post 10 to be secured thereto and to be held snugly so as to be rotatable relative to the post 10 only upon application of substantial rotary force to one while holding the other stationary. In this manner, the mounting device 12 remains in a predetermined orientation relative to the post 10 unless adjusted by a user.

Figure 5:
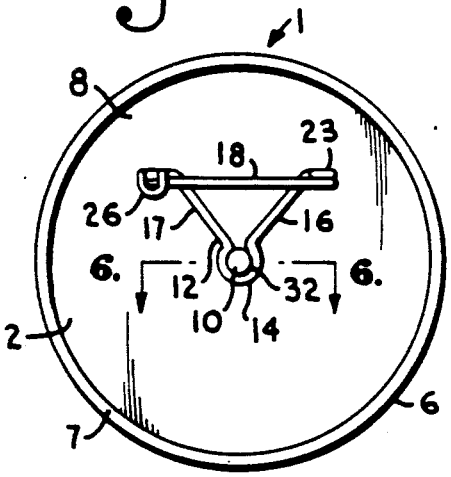
FIG. 5 is an enlarged rear elevational view of the badge subsequent to attachment of the connecting assembly to the badge.

The shank portions 16 and 17 are aligned in a single plane and are connected to and continuously extend from opposite ends of the base portion 14. The shank portions 16 and 17 extend generally radially outward from an axis of the base portion 14 generally represented by the reference letter B. The axis B is generally coaxial with the axis A when the mounting device 12 is positioned on the badge body 2, as shown in FIG. 5. The shank portion 16 is connected to the pin portion 18 which extends generally transversely to the axis B of the base portion 14. The pin portion 18 is also spaced generally from the axis B of the base portion 14 such that placement and retention of the assembled badge 1 in the intended application thereof can be assisted gravitationally.

The pin portion 18 is braced to rotate away from the plane formed by the shank portions 16 and 17 about the end of the shank portion 16. The pin portion 18 terminates in a pointed end 22. The pin portion 18 is connected to the shank portion 16 through a spring or biasing coil 23 that provides operative resilience to pin portion 18.

The second shank portion 17 is connected to an arm portion 24 and is generally spaced from the base portion 14 at an obtuse angle to the shank portion 17 and located in the plane formed by the shank portions 16 and 17. A finger 26 is connected to and extends generally from the arm portion 24 and forms a loop for capturing the pin portion 18 when the latter is in a secured configuration wherein the pin portion 18 is biased into and held by the loop of the finger 26, such as is shown in FIG. 4.

The construction and spacing of the various parts of the pin mounting device 12 are such that the pin portion 18 may be threaded through an article, such as clothing, fabric, or other penetrable material, and the free pointed end 22 of pin portion 18 then swung or rotated to releasably engage the loop formed by finger portion 26 which will retain the pin portion 18 in a secured configuration while concurrently shielding the pointed end 22. The connection 23 between the shank portion 16 and the pin portion 18 is resistant and biases or urges the free end 22 against the loop formed by the finger 26.

The pin portion 18 is movable between the secured configuration and a non-secured configuration by an operator digitally counteracting the biasing of connection 23 to rotate the pin portion 18 over a loop front end 25. When in the secured configuration thereof, the pin portion 18 is approximately aligned parallel to the plane formed by the shank portions 16 and 17 and spaced therefrom a distance greater than the rearward projection of the rim 6 from the rear face 8 of the badge body 2.

The finger portion 26 of the pin mounting device 12 is spaced laterally from the coil 23 such that sufficient penetrable material may be intercepted between the coil 23 and the finger portion 26 by the pin portion 18, as is necessary to support the completed badge and mounting assembly in its intended application.

Figure 6:
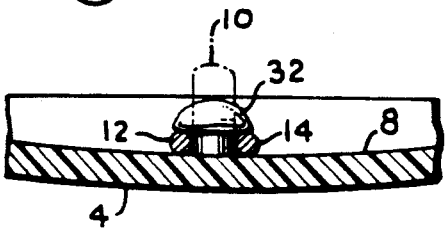
FIG. 6 is an enlarged and fragmentary cross-sectional view of the badge showing the connecting assembly mounted on the body, taken along line 6—6 of FIG. 5.

During assembly, the base portion 14 of the pin mounting device 12 would be aligned with and slidably pressed onto the post 10, until the base portion 14 abuts against the rear face 8 of the badge body 2, such that the end of the post 10 protrudes through the base portion 14 as shown in FIG. 5. The end 11 of the post 10 is then deformed by swaging, by staking, by application of ultrasonic vibration, or otherwise, whereby the dimensions of a deformed end 32 that are perpendicular to the longitudinal axis B of post 10 are greater than the diameter of a semi-circular opening 33 of the base portion 14, thereby permanently rotatably, pivotally and coaxially securing the pin mounting device 12 to the badge body 2, as illustrated in FIG. 6.

It is foreseen that a post for use with the pin mounting device may be a separate, non-integral device, flanged and insertible through an appropriately dimensioned opening in the center of the front face 4. Such a post may be physically held, adhesively secured, or snapped into place and then assembled as aforesaid.

It is also foreseen that the post may be non-integral and fabricated with an enlarged distal end having initial transverse dimensions greater than the diameter of the semi-circular opening 33 of the base portion 14. In this particular alternative, the post could subsequently be adhesively or otherwise secured to the center of the rear face 8 after pressing the base portion 14 of the pin mounting device 12 onto the post 10.

After assembly, the semi-circular opening 33 of the base portion 14 functionally grips the post 10, but the badge body 2 can be coaxially and pivotally turned or rotated relative to the pin mounting device 12 to provide any desired orientation.

Figure 7:
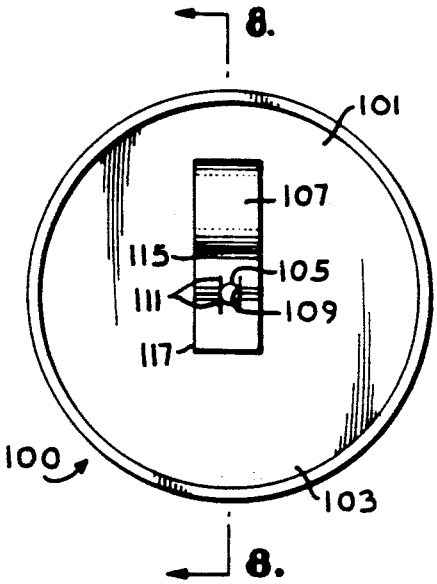
FIG. 7 is a rear elevational view of a first modified badge in accordance with the present invention with a clip mounting assembly.
Figure 8:
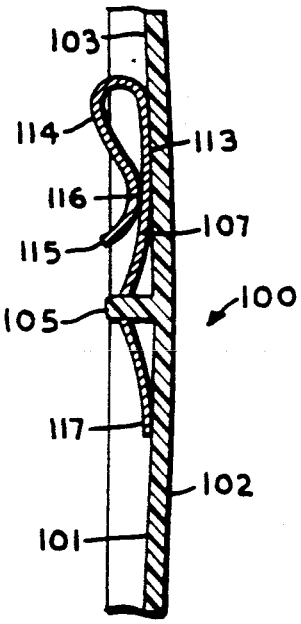
FIG. 8 is an enlarged and fragmentary cross-sectional view of the first modified badge, taken along line 8—8 of FIG. 7.

A first modified badge and mounting assembly embodiment in accordance with the present invention is shown in FIGS. 7 and 8 and is generally represented by the reference numeral 100.

The first modified badge and mounting assembly includes a badge body 101 having a front face 102, a rear face 103 and an integral, generally cylindrically-shaped post 105 centrally located to extend rearward perpendicular to the rear face 103.

A clip mounting device 107 is constructed of flat, resilient material such as metal, plastic or otherwise and dimensioned to provide sufficient strength and support for its intended purpose.

The clip mounting device 107 has an opening 109 with dimensions slightly smaller than the diameter of post 105 and typical slots 111 for allowing enlargement of the opening 109 during assembly. The actual size of the opening 109 is such that the clip mounting device 107 can be simply and easily secured to the post 105 by pressing thereon.

The clip mounting device 107 has a base 113, a hook 114, a lip 115, a throat 116, and a toe 117. The clip mounting device 107 is formed and configured such that the throat 116 is in sufficiently close proximity to frictionally secure the assembled badge and clip mounting assembly to clothing, fabrics, or other relatively thin materials.

Alternatively, the clip mounting device may be similarly fabricated without a hook, but rather with a lip formed by turning up the outer end of the base to provide ease of attachment to relatively thin material and a throat would exist and lie between the base and the rear face.

During assembly, the opening 109 is aligned with the post 105 and mechanically pressed or twisted onto the post 105 until the base 113 and the toe 117 are pressed against the rear face 103 of the badge body 101, thereby permanently securing the clip mounting device 107 to the badge body 101. Preferably, the mounting device 107 is automatically self-securing to the post 105, as a speed nut, and the post 105 does not require further deformation to secure the mounting device 107. However, if necessary for certain applications, the end of post 105 protruding through the opening 109 of the clip mounting device 107 may be mechanically, thermally, chemically, or otherwise deformed to more permanently secure the clip mounting device 107 to the badge body 101.

After assembly, the badge body 101 can be coaxially and pivotally rotated or turned to provide any desired orientation of the badge body 101 relative to the clip mounting device 107.

Figure 9:
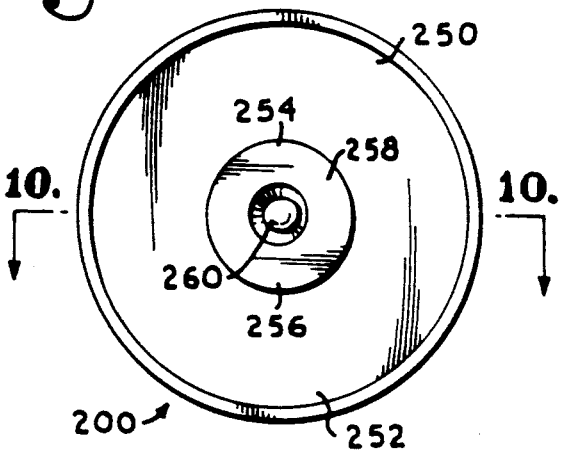
FIG. 9 is a rear elevational view of a second modified badge in accordance with the present invention with a magnetic mounting assembly.
Figure 10:
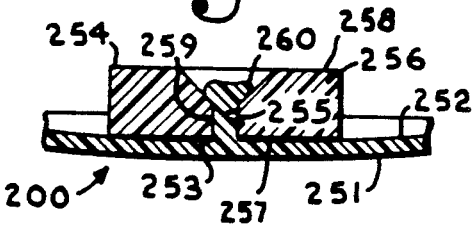
FIG. 10 is an enlarged and fragmentary cross-sectional view of the second modified badge, taken along line 10—10 of FIG. 9.
Figure 11:
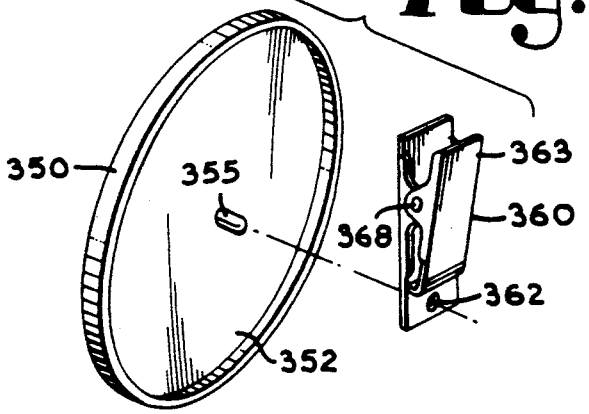
FIG. 11 is an exploded perspective view of a third modified badge in accordance with the present invention.
Figure 12:
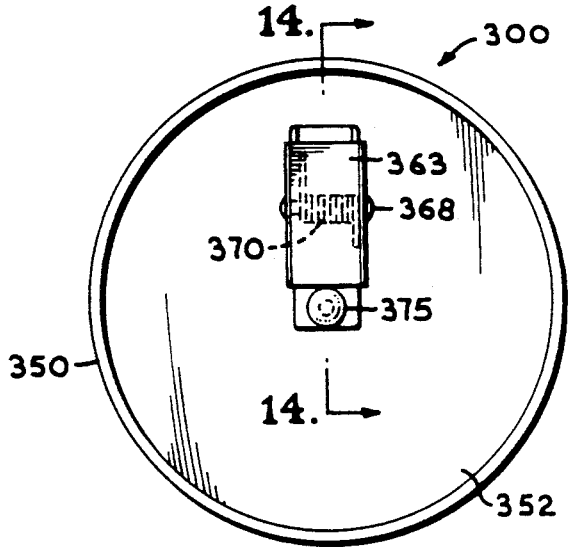
FIG. 12 is an enlarged rear elevational view of the third modified badge.
Figure 13:
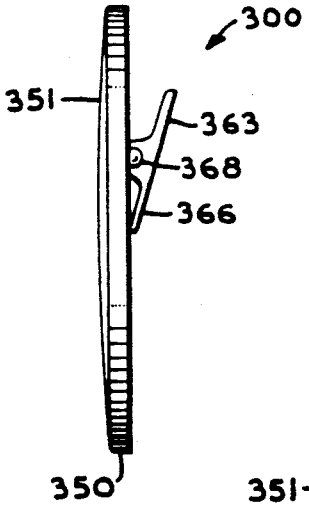
FIG. 13 is an enlarged side elevational view of the third modified badge.
Figure 14:
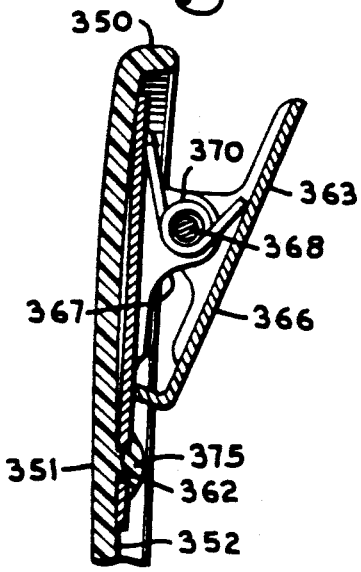
FIG. 14 is an enlarged and fragmentary cross-sectional view of the third modified badge, taken along line 14—14 of FIG. 12.

A second modified badge and mounting assembly embodiment in accordance with the present invention is illustrated in FIGS. 9 and 10 and is generally designated by the reference numeral 200.

The second badge and mounting assembly 200 embodiment includes a badge body 250 having a front face 251, a rear face 252 and an integral, generally cylindrically-shaped post 255. A magnet mounting device 256 is custom formed with a generally cylindrical contour. The magnet mounting device 256 has a front planer face 257 and a rear planar face 258 and has a thickness such that the rear face 258 after assembly extends at least about 1/16 inch beyond the rearmost projection of the badge body 250. A bore 259 with diameter slightly larger than the diameter of the post 255 extends axially through the magnet mounting device 256, whereby the post 255 is slidably insertible through the bore 259. The bore 259 is V-shaped countersunk approximately three-fourths of its depth. The rearward extension of the post 255 from the rear face 252 of the badge body 250 is such that the post 255 can be deformed during assembly such that the magnet mounting device 256 is permanently secured to the badge body 250, as shown in FIG. 10.

During assembly, the post 255 is aligned with and inserted into bore 259 until the magnet mounting device 256 is pressed against and is juxtaposed to the rear face 252 of the badge body 250. Thereafter, a chemical, thermal, or mechanical deformation 260 of the protruding end of post 255 is accomplished, thereby permanently securing the magnet mounting device 256 to the badge body 250, as illustrated in FIG. 10. Preferably, the deformation 260 is performed such that the rearmost extremity of the post 255 would not protrude beyond the rear face 258 of magnet mounting device 256.

A third modified badge and mounting assembly in accordance with the present invention is illustrated in FIGS. 11–15 and is generally designated by the reference numeral 300.

The third badge and mounting assembly 300 includes a badge body 350 having a front face 351, a rear face 352 and an integral, centrally mounted and generally cylindrically-shaped post 355 extending rearwardly from the rear face 352. Preferably, the post 355 extends perpendicularly from the rear face 352.

A mounting assembly 360 includes means for receiving and being attached to the post 355, such as illustrated bore 362 and an alligator clip mechanism 363 for securing to clothing, such as the illustrated shirt pocket 364. The alligator clip mechanism 363 (sometimes also referred to as a "bulldog" clip) includes a pair of opposed jaws 366 and 367 pivotally mounted with respect to each other on a pivot pin 368. The jaws 366 and 367 are urged together by biasing means, such as the illustrated spring 370.

The mounting assembly 360 is secured to the badge body 350 by placement of the badge body post 355 through the mounting assembly bore 362 and thereafter swedging or otherwise spreading the rearwardly extending portion of the post 355 so as to make a rearward portion 375 of the post 355 too large to pass through the bore 362. The enlargement of the rear portion 375 of the post 355 can be accomplished in such a manner that the mounting assembly 360 is pivotal about the post 355 or, alternatively, snuggly held in a single position.

Figure 15:
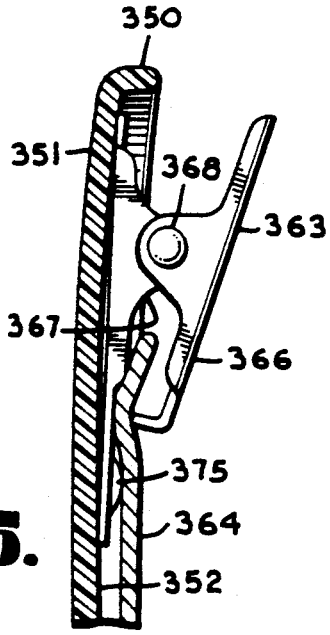
FIG. 15 is an enlarged and fragmentary cross-sectional view of the third modified badge similar to FIG. 14, shown mounted on a shirt pocket.

During use, the third badge and mounting assembly 300 is secured to a shirt pocket 364 or the like, such as is illustrated in FIG. 15, by manipulating the jaws 366 and 367 to an open position by compression of the spring 370 and then placement of the jaws 366 and 367 over the material to which it is to be secured, after which same are released. When the badge body 350 is printed with a message or with a design which must be oriented in a particular direction, the badge body 350 may be rotated relative to the assembly 360 to provide alignment thereof.

While the posts of the illustrated embodiments have been shown as a solid posts, it is also foreseen that the post may be molded as a tubular structure which would have certain advantages for particular embodiments of the invention. For example, the tubular post may be more easily staked during the assembly process than a solid post for certain embodiments of the assembly Also, during the molding process, the tubular post is less likely to create a sinkhole on the face of the button opposite the post.

It is also seen that in certain embodiments of the invention, it may be advantageous to positively lock the pin or other mounting assembly to the post in such a manner that the pin cannot rotate relative to the post. This may be accomplished by totally encapsulating the portion of the mounting assembly surrounding the post with plastic from the post. That is, a portion of the plastic bridges between the top of the post and the back of the badge body over the mounting assembly, so as to prevent the mounting assembly, which is non-circular, from rotating. It is noted that encapsulation in this manner is only desirable where the mounting assembly can be positively positioned relative to the face of the badge body prior to mounting, since there is no ability to adjust the mounting assembly after attachment is complete.

It is to be understood that while certain forms of the present invention have been illustrated and described herein, it is not to be limited to the specific forms or arrangement of parts described and shown.

What is claimed and desired to be secured by Letters Patent is as follows:

1. A latchable pin mounting device comprising:

(a) a base portion in the form of a circular segment and lying in a first plane having an arc greater than a semi-circle such that said base portion has a curved configuration located about an axis and is adapted to be coaxially secured to a post;

(b) a first arm portion connected to one end of said base portion to support a pin portion by bias pivoting means substantially spaced relationship to said base portion;

(c) a second arm portion connected to the other end of said base portion to support a latching portion having a finger for operably retaining said pin when positioned in a latched configuration thereof;

(d) said pin portion adapted to removably attach said pin mounting device to penetrable material; said pin portion having an open configuration and said latched configuration both within a common second plane spaced orthogonal to said first plane, such that in use said pin portion is offset from said base portion.

2. The pin mounting device of claim 1, including:

(a) a connection portion between said pin portion and said base portion; and (b) said connection portion resiliently biasing said pin portion so as to retain said pin portion within said latching portion when in the latched configuration thereof.

3. The pin mounting device of claim 2 wherein:

(a) said pin mounting device is constructed of a continuous length of resilient material.

4. The pin mounting device of claim 2 wherein:

(a) said pin portion rotates about an axis of rotation that is angled substantially 90° relative to a central axis of said base portion; and (b) said axis of rotation and said central axis are substantially spaced apart.

5. A badge and mounting assembly comprising:

(a) a badge body;

(b) a centrally located post extending rearwardly from a rear face of said badge body;

(c) a mounting assembly being rotatably, pivotally and coaxially secured about said post; said mounting assembly comprising:

(1) a base portion having a circular arc greater than a semi-circle and being received about said post;

(2) a pin portion adapted to removably connect said mounting assembly to penetrable material;

(3) an arm portion supporting said pin portion; and (4) a latching finger portion for operably latching said pin portion when in a latched configuration thereof; and (d) a biasing connection portion resiliently connecting said pin portion to said base portion and operatively biasing said pin portion against said finger portion when in the latched configuration thereof; and (e) said mounting assembly being constructed of a continuous and integral length of resilient material.

6. The badge and mounting assembly of claim 5 wherein:

(a) said base portion has a central axis coaxial with said post and oriented at substantially a right angle to an axis of rotation of said pin portion; and (b) said pin portion being substantially spaced from said post during operative use.

7. A badge and mounting assembly comprising:

(a) a circular badge body with an integral centrally located post extending perpendicularly from a rear face thereof; said post being constructed of deformable material and being generally cylindrically shaped prior to construction of said assembly;

(b) a pin mounting device constructed of continuous resilient material; said pin mounting device including a base portion having a circular arc greater than a semi-circle, a first offsetting shank portion joined at a first end to said base portion and at a second end to a biasing connecting portion; said connecting portion joined opposite said first shank portion to a pin portion with a pointed end; a second offsetting shank portion connected to the base portion at a first end thereof and to a looped finger portion at a second end thereof; said finger portion, when said pin portion is in a latched configuration thereof, operatively retaining said pointed end of said pin portion; and (c) said pin mounting device permanently rotatably, coaxially and pivotally secured to said badge body after construction by deformation of a distal end of said post such that the transverse dimensions of the distal end of the post after deformation are greater than the diameter of said circular arc of said base portion and an axis of rotation of said pin portion being operably spaced by said first shank portion from said post and being generally oriented at a right angle to a central axis of said post.

* * * * *